US006231730B1

(12) United States Patent
Davis et al.

(10) Patent No.: US 6,231,730 B1
(45) Date of Patent: May 15, 2001

(54) CATHODE FRAME

(75) Inventors: Steven S. Davis; Forrest B. Day, both of Farmington; Calvin C. Mills, Bountiful, all of UT (US)

(73) Assignee: EpviroTech Pumpsystems, Inc., Salt Lake City, UT (US)

( * ) Notice: Subject to any disclaimer, the term of this patent is extended or adjusted under 35 U.S.C. 154(b) by 0 days.

(21) Appl. No.: 09/454,554

(22) Filed: Dec. 7, 1999

(51) Int. Cl.[7] ..... C25B 9/00

(52) U.S. Cl. ..... 204/279; 204/281; 204/282; 204/286.1; 204/287; 204/288.3; 204/288.4; 204/288.5; 204/288.6; 204/297.01; 204/297.14; 204/297.16

(58) Field of Search ..... 204/279, 281, 204/282, 286.1, 287, 288.3, 288.4, 288.5, 288.6, 297.01, 297.14, 297.16

(56) References Cited

U.S. PATENT DOCUMENTS

| | | | | |
|---|---|---|---|---|
| 3,298,945 | * | 1/1967 | Weis et al. | 204/281 |
| 3,677,929 | * | 7/1972 | Young, Jr. | 204/288.3 |
| 3,798,151 | * | 3/1974 | Takamura et al. | 204/281 |
| 4,040,937 | * | 8/1977 | Iijima et al. | 204/281 |
| 4,207,147 | * | 6/1980 | Babin | 204/281 |
| 4,282,082 | | 8/1981 | Cook et al. | 204/237 |
| 4,288,312 | | 9/1981 | Johnson et al. | 204/281 |
| 4,304,650 | * | 12/1981 | Matsuo et al. | 204/281 |
| 4,455,209 | * | 6/1984 | Hermann | 204/297.14 |
| 4,568,434 | | 2/1986 | Morris et al. | 204/279 |
| 4,575,409 | * | 3/1986 | Dragon, Jr. et al. | 204/279 |
| 4,670,124 | * | 6/1987 | Bartsch et al. | 204/281 |
| 4,776,928 | | 10/1988 | Perlich | 204/281 |
| 4,776,941 | | 10/1988 | Tezanos | 204/259 |
| 5,002,642 | | 3/1991 | Kaneko et al. | 204/297 |
| 5,314,600 | | 5/1994 | Webb et al. | 204/279 |
| 5,393,396 | | 2/1995 | DeWitt et al. | 204/281 |
| 5,470,445 | | 11/1995 | Murray et al. | 204/279 |
| 5,690,798 | | 11/1997 | Alexander et al. | 204/279 |
| 5,785,827 | * | 7/1998 | Dougherty | 204/281 |

* cited by examiner

*Primary Examiner*—Bruce F. Bell
(74) *Attorney, Agent, or Firm*—Morriss, Bateman, O'Bryant & Compagni

(57) ABSTRACT

A cathode frame for receiving and retaining a cathode plate for electrowinning and/or electrorefining processes is constructed as an integrally-formed frame body having a base member and side members which provide a continuous channel therethrough for retaining the peripheral edge of a cathode plate, and is further structured with a cross frame extending between the side members for receiving a cathode plate therethrough. The cross frame is sized and positioned to extend proud of the frame body thereby providing contact surfaces for striking when recovering the cathode plate from the frame. In an alternative embodiment of the invention, the cross frame is integrally formed with the side members and base member and the cathode frame is configured to retain a filter media thereagainst.

19 Claims, 6 Drawing Sheets

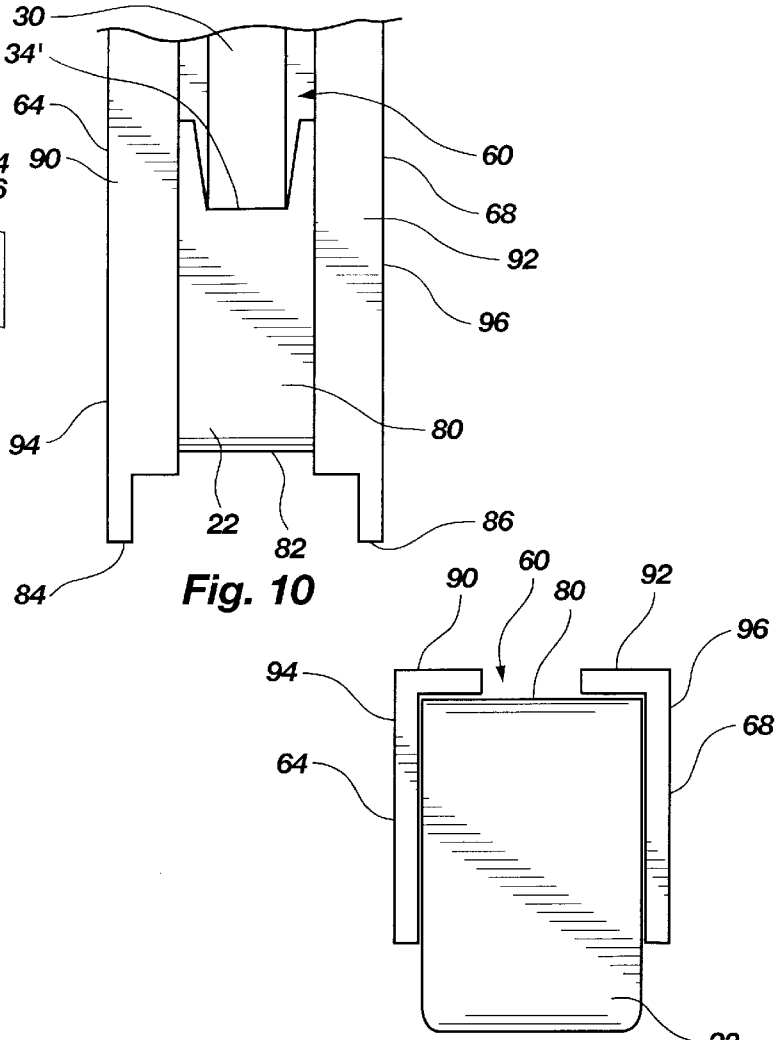
Fig. 10
Fig. 11
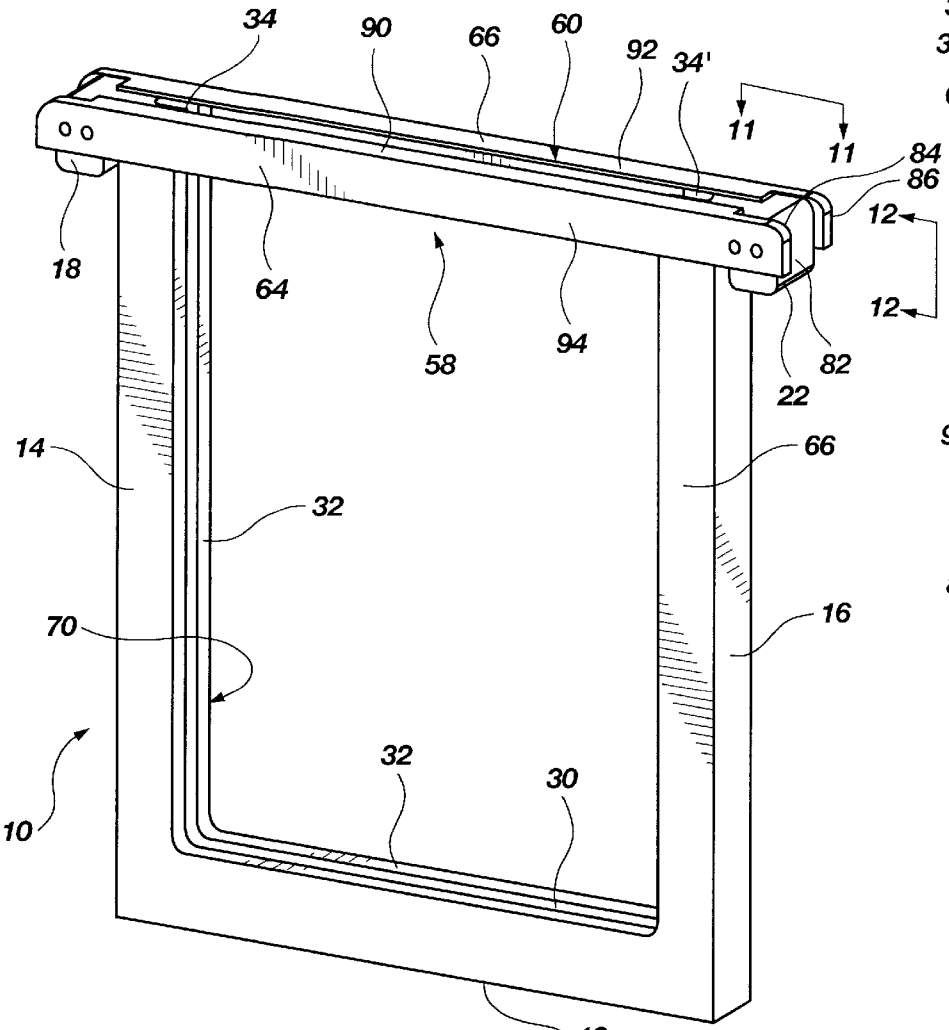
Fig. 9

CATHODE FRAME

BACKGROUND OF THE INVENTION

1. Field of the Invention

This invention relates to electrowinning and electrorefining processes which employ alternating cathode and anode plates positioned in an electrolytic solution, and specifically relates to integrally formed frames for retaining a cathode plate therein.

2. Description of Related Art

Many mining and metallurgical operations employ electrolytic processes to recover or refine metals, such as cobalt or zinc. The primary electrolytic processes that are used in such operations are electrowinning, electrorefining or a combination of those two. In electrowinning, metals are typically recovered from an electrolyte solution containing such metals using an insoluble anode and a cathode having a starter sheet made of the same metal as that being recovered, or another suitable material. In electrorefining, purified metal is transferred from the anode, which is made at least in part from the metal, through the electrolyte to the cathode. In both electrowinning and electrorefining, the recoverable or refinable metal is plated or otherwise adhered to the cathode starter sheet. In some operations, a combination of electrowinning and electrorefining processes may be employed to recover metals. For example, a target metal may be transferred from a soluble anode positioned in tank to the surrounding electrolyte, which is then piped from the tank into an isolated cathode starter sheet to facilitate electrowinning of the metal from the electrolyte solution.

In any of the processes previously described, vertically-oriented anode plates and cathode plates are typically arranged side-by-side in alternating arrangement within a tank sized to receive the anode and cathode plates. The anode, and particularly the cathode plate, may be positioned within a frame to maintain it in vertical orientation and in proper proximity to the next adjacent anode or cathode. Depending on the processes being carried out and the metal being recovered or refined, the anode, cathode or both, may be covered with a permeable media which allows metal ions to pass through the media into the electrolyte, but which does not allow impurities or other material to pass through to the electrolyte. The tank holds the electrolyte solution in which the anode and cathode plates are positioned. A certain level of electrolyte may typically be maintained in the tank to facilitate the recovery or refining of metals.

After sufficient time has passed for the recovery or refining of metal on the cathode plate, the cathode frame and plate are removed from the tank so that the metal deposits from the cathode starter sheet, or plate, can be recovered. The cathode plate must be removed from the surrounding frame to access the deposited metals, but the build-up of metal on the initial starter sheet often makes it difficult to remove the cathode plate from the cathode frame. Hence, it is quite common for the technicians to pound, hammer or beat on the cathode frame in an effort to separate or dislodge the cathode plate from the frame.

Early cathode frame designs were conventionally manufactured from wood or relatively durable plastic material and the frames comprised edge sticks or strips which were positioned along each of the three submerged sides of the cathode plate. Examples of such cathode frames are disclosed in, for example, U.S. Pat. No. 4,282,082 to Cook, et al.; U.S. Pat. No. 4,288,312 to Johnson, et al.; U.S. Pat. No. 4,776,928 to Perlich; U.S. Pat. No. 5,314,600 to Webb, et al. and U.S. Pat. No. 5,690,798 to Alexander, et al. However, the deposition of metal on the starter sheet made removal of the cathode plate from the frame very difficult.

In more recent years, the conventional edging strips used to mask the edges of the cathode plate have been configured to join or abut each other to enclose the peripheral edge of that portion of the cathode plate which is submerged. The intersecting or abutting edges of adjacent edge strips have typically been sealingly joined, such as with adhesives, to secure the edge strips together and to prevent electrolyte from seeping between abutting edges. Such construction has been considered to be more efficient and economical in terms of manufacture and maintenance of the cathode frame. However, it has also been recognized that the adhesive or other bonding method used to join the abutting edge strips eventually dissolves or degrades over time, thereby allowing electrolyte to seep between the edge strips and the integrity of the frame as a whole is compromised. U.S. Pat. No. 5,690,798 proposes a solution to the problem by providing corner protectors which are structured to receive the ends of edge strips which form the sides and bottom of the frame. The ends of the edge strips are inserted into the corner protectors and are adhesively joined together. The corner protector is described as providing a friction fit with the edge strips to, presumably, prevent electrolyte from seeping between the corner protector and the edge strip.

As previously noted, when the cathode frame and plate are removed from the tank for recovering the deposited metal, the deposition of the metal makes removal of the cathode plate from the frame very difficult, and it is common to have to resort to extreme measures to remove the plate from the frame. Most commonly, the top outer corners or sides of the frame are hammered repeatedly until the plate gives way from the frame. However, the extreme measures of hammering or pounding on the frame frequently cause the frame to break or crack, typically at the point of joinder of the separate side and/or corner elements where the adhesive has degraded. Additionally, wooden frames are unable to withstand the extreme abuses employed to remove the plate from the frame and are equally weakened by the acidic environment of the electrolyte. The development of unitarily formed frames has enabled a marked improvement in maintaining the integrity of cathode frames; however, damage still occurs when the frames are hammered as described.

Thus, it would be advantageous in the art to provide a cathode frame which is especially designed and structured to withstand the normal abuses to which cathode frames are subjected, thereby increasing the useful life of the cathode frame, and to structure a cathode frame which will withstand the harsh environment of the electrolytic process.

BRIEF SUMMARY OF THE INVENTION

In accordance with the present invention, a frame for retaining the peripheral edges of a cathode plate is integrally formed to provide strength and durability to the cathode frame in the harsh environment of the electrolyte in an electrolytic process. Further, the cathode frame of the present invention is structured to provide increased resistance to degradation of the frame resulting from striking the frame to remove the cathode plate from the frame. The structure of the cathode frame of the invention also provides improved masking of the peripheral edges of the cathode plate to facilitate the uniform deposition of metal to the cathode plate. The increased strength of the cathode frame provided by its integral construction strengthens the frame in the area of the corners, provides electrical shielding in the corners and increases the overall strength of the frame to avoid deformation (e.g., warping) of the frame during exposure to the electrolyte.

The cathode frame of the present invention is formed with an integral body construction to provide strength and to provide a frame which is able to withstand the abuse to which cathode frames are typically subjected. As used herein, "integral" means that the frame is formed as a single piece of material, rather than separate portions later assembled into a whole. However, as described further hereinafter, separate elements may be added after formation of the integrally-constructed frame, but such added elements are typically not exposed to the harsh environment of the electrolyte.

The integrally-formed frame body consists of a base member, two opposing side members spaced apart from each other and oriented perpendicular to the base member, and a handle extending outwardly from each of the two side members near the end of each side member positioned away from the base member. The handles provide means for supporting the frame along the sides of an electrolytic tank, or on some structure associated with the tank sides for that purpose. The integral construction of the handles as a part of the cathode frame enable the frame to be raised by the handles without having the handles warp or separate from the side members to which they are formed, as is commonly the occurrence with conventional cathode frames where the handles comprise separate pieces which are adhesively bonded to the sides of the frame. Further, the integral construction of the handles to the respective side members enables the frame to withstand repeated striking, as may be necessary to remove the cathode plate from the cathode frame, without damaging the frame.

Where each side member is formed with the base member, a perpendicular angle or corner is formed therebetween. Each of the corners is formed with a radius which provides strength at the transition between the base member and each side member and provides an advantage over conventional cathode frames which are adhesively joined or bonded at the junction between the base member and side members. That is, when conventional cathode frames are lifted from the electrolyte for removal of the plate and the cathode frame is struck or hammered to separate the plate from the frame, the hammering or other abuse often causes failure of the frame at the joint between the side members and the base member. Integrally-formed frames are structured so that they can take repeated hammering without injury to the frame. The radiused corners of the cathode frame also have the more particular advantage of masking the cathode plate positioned in the frame so that metal is more evenly deposited on the plate, a factor which also facilitates removal of the plate from the cathode frame.

A channel is formed along the inside edge of the two side members and base member of the cathode frame and is continuous about the inside edge of the cathode frame. The channel is formed to receive the outer peripheral edge of a cathode plate inserted into the cathode frame. The channel is structured to center the cathode plate within the cathode frame and to space the plate an appropriate distance from the diaphragm or filter membrane, which may be used to enclose the frame. The channel of the cathode frame may have any shape in lateral cross section which is suitable for engaging the peripheral edge of a cathode plate to center the plate within the frame and to provide increased strength of the frame between the periphery of the plate and the sides and bottom of the cathode frame.

The cathode frame of the present invention includes a cross frame extending between the two side members near the top of the frame to provide an essentially four-sided frame. The cross frame is formed with a slot which is in alignment with the channel formed in the side members and base member of the frame, and the slot is sized to receive the cathode plate therethrough. A diaphragm, or filter media, usually consisting of a fabric bag, may be positioned over the frame to extend from the bottom of the frame to the top of the frame. The diaphragm allows metal ions to pass therethrough, but prevents impurities from passing through so that a plate of pure metal is formed. The cross frame provides structure for attachment of the diaphragm to the cathode frame. The cross frame may be integrally formed as part of the entire frame or may be separately formed and attached to the frame by such attachment devices as bolts, pins, adhesive bonding or any other suitable means.

The cross frame of the present invention is particularly structured to provide contact surfaces against which a hammer or other object may be struck to loosen the cathode plate from the frame, as is the conventional manner, but the contact surfaces are also structured or located on the cross frame in a manner which also shields the frame body from direct damage which may be caused by striking or hammering the cathode frame. The cross frame may be made of stainless steel or any other suitable material which is acid-resistant and able to withstand repeated striking.

The cathode frame of the present invention is manufactured from an electrically-insulating material, such as a plastic, which also provides structural strength to the frame. The cathode frame of the present invention may be manufactured from a glass-reinforced mixture of a plastic material to impart particular strength to the cathode frame so that, when subjected to the high temperature conditions of the electrolytic environment, the cathode frame does not warp, bend or deform in some similar manner. The increased strength of the material also helps the cathode frame withstand the abusive treatment which typically occurs in electrolytic processes when moving the cathode and anode plates. The cathode frame is formed by inserting the material into a mold designed to provide the described structure of the cathode frame. Further machining may be desirable or required to, for example, finish rough edges or to radius the inside corners of the cathode frame.

BRIEF DESCRIPTION OF THE DRAWINGS

In the drawings, which currently illustrate what is considered to be the best mode for carrying out the invention:

FIG. 9 is a view in perspective of an alternative embodiment of the present cathode frame;

FIG. 10 is a plan view of one of the handles of the cathode frame shown in FIG. 9, taken at line 9—9 thereof;

FIG. 11 is a view in elevation of the handle shown in FIG. 9, taken at line 11—11;

DETAILED DESCRIPTION OF THE DRAWINGS

Figure 1:
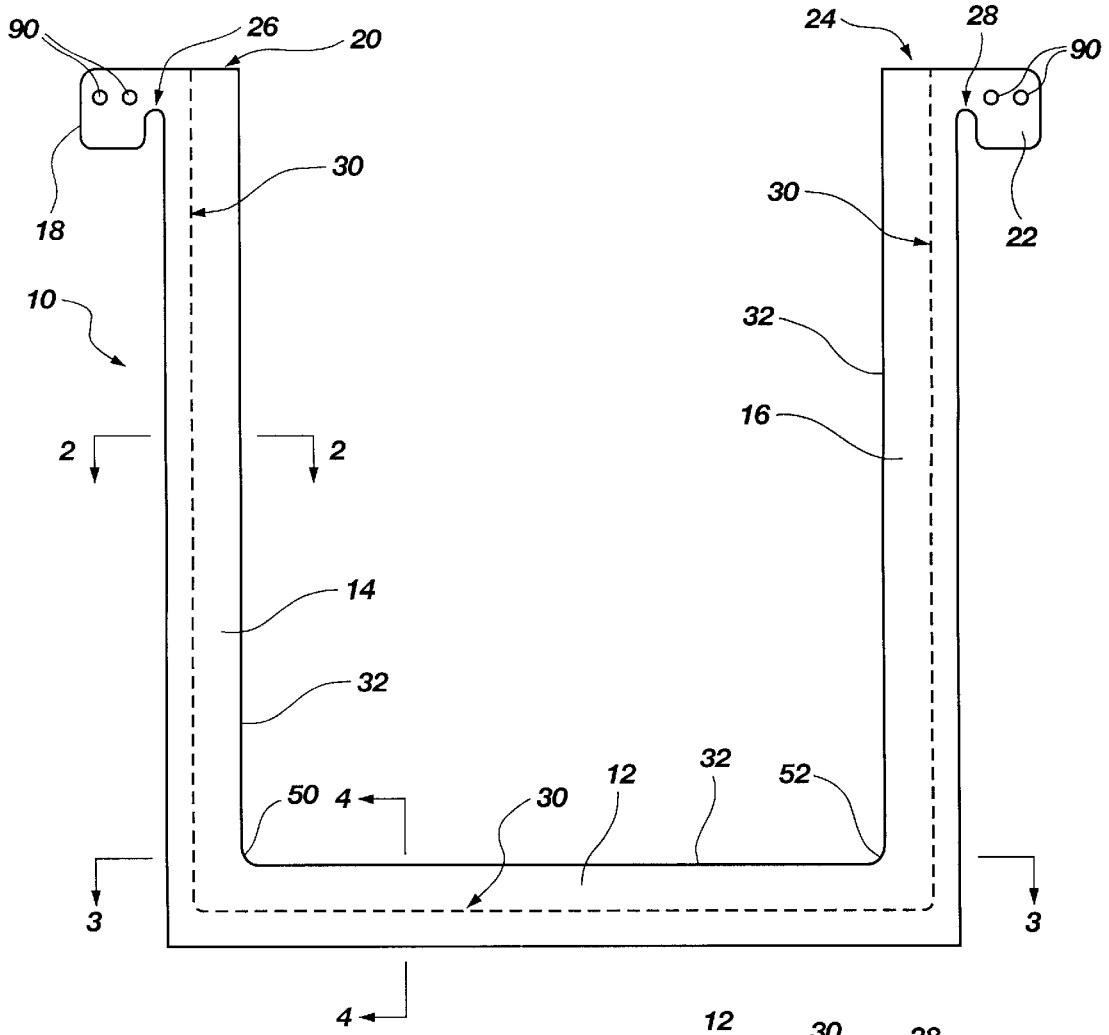
FIG. 1 is a view in elevation of a known cathode frame used in electrowinning processes.
Figure 2:
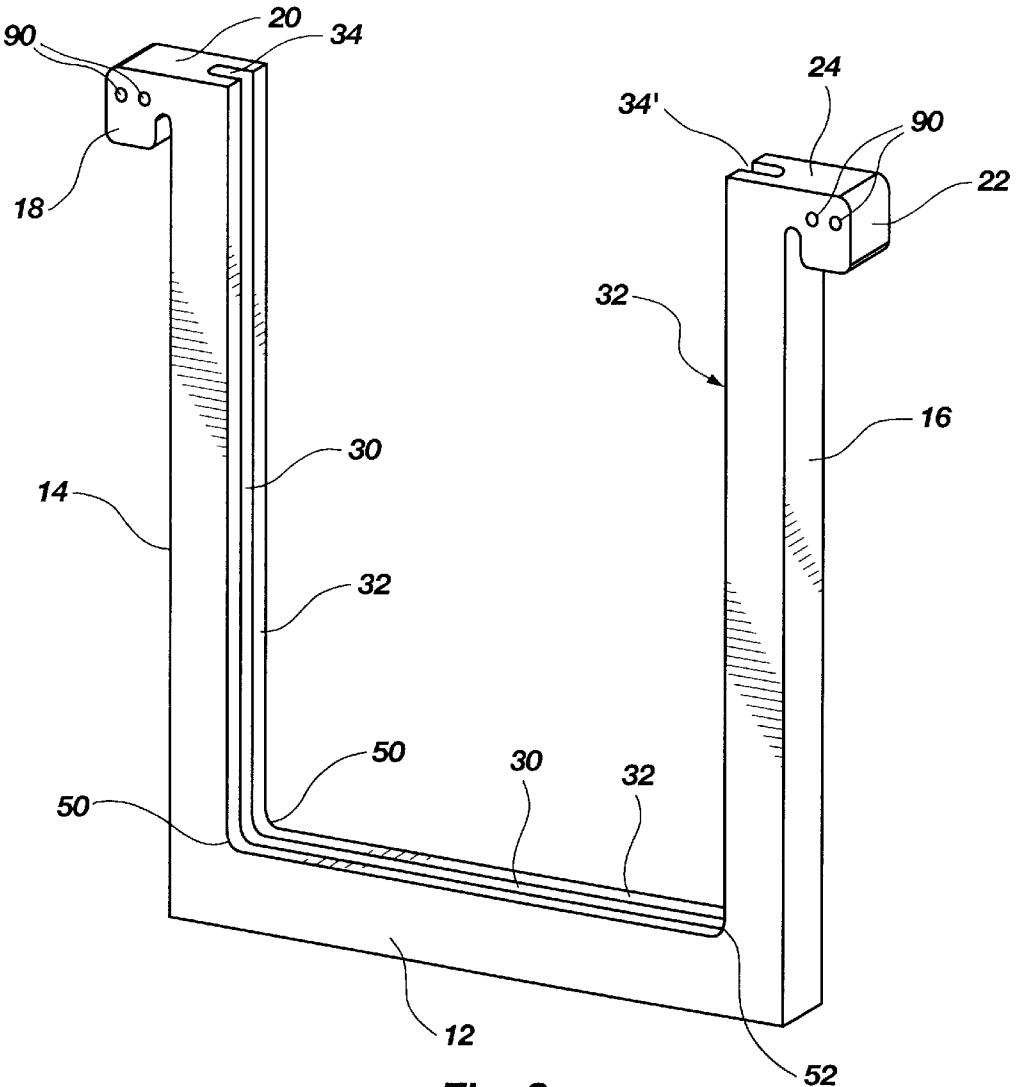
FIG. 2 is a view in perspective of the cathode frame shown in FIG. 1.

FIGS. 1 and 2 illustrate the general features of a cathode frame 10 of known construction, formed in a unitary construction. The cathode frame 10 is formed or molded as a single piece of material which imparts strength and durability to the cathode frame unit. The cathode frame 10 is integrally formed as a unitary body having a base member 12 positioned to support the bottom edge of a starter sheet, or cathode plate (not shown), a first side member 14 in perpendicular orientation to the base member 12 and a second side member 16 in parallel orientation to, and spaced apart from, the first side member 14. The second side member 16 is also in perpendicular orientation to the base member 12. A first handle 18 is positioned near the top 20 of the first side member 14 and a second handle 22 is similarly positioned near the top 24 of the second side member 16. The first handle 18 and second handle 22 are provided for supporting the cathode frame 10 on the opposing sides of an electrolytic tank and also provide means for lifting the cathode frame 10 from the tank when necessary. The unitary construction and formation of the first handle 18 and second handle 22 to its respective side member 14, 16 provides advantageous strength to the cathode frame 10 at the transition point 26, 28 between each handle 18, 22 and its respective side member 14, 16. In conventional frames that are constructed from separate pieces, there is an often-observed failure of the frame at the connection point of the handle to the side of the frame, particularly when the frame is struck or hammered to separate the cathode plate from the cathode frame 10. No such failure or damage results with the present invention.

A continuous channel 30 (represented in FIG. 1 as a dotted line) is formed along the inside edge 32 of the cathode frame 10 and is continuously formed in the first side member 14, the base member 12 and the second side member 16. The continuous channel 30 is sized to receive the peripheral edges (i.e., sides and bottom edge) of a starter sheet. The cathode starter sheet (not shown) is inserted into the top openings 34, 34' of the channel 30 at the top 20, 24 of the respective side members 14, 16, as shown in FIG. 2. The starter sheet is inserted until the bottom edge of the starter sheet comes to rest in the continuous channel 30 formed in the base member 12 of the cathode frame 10.

Figure 4:
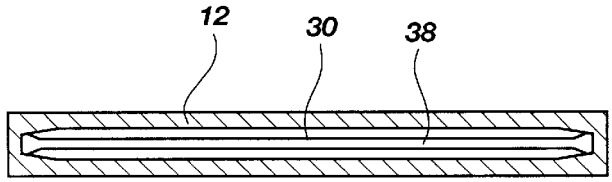
FIG. 4 is a view in lateral cross section of the frame shown in FIG. 1, taken at line 3—3.
Figure 3:
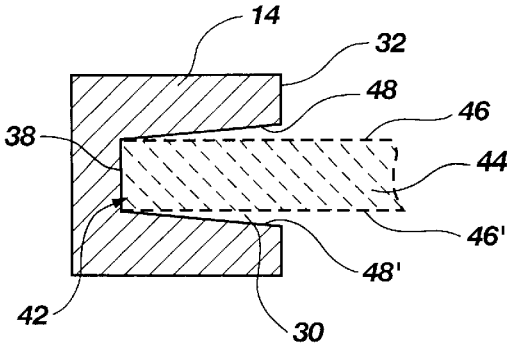
FIG. 3 is an enlarged view in lateral cross section of one of the side members of the frame taken at line 2—2 of FIG. 1.
Figure 5:
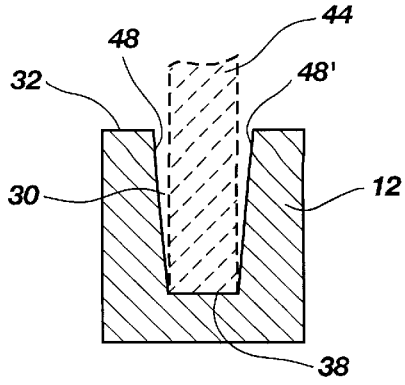
FIG. 5 is an enlarged view in lateral cross section of the base member of the frame shown in FIG. 1, taken at line 4—4.

The channel 30 formed in the cathode frame 10 may have any suitable configuration, as viewed in lateral cross section, as long as the channel 30 is sized and configured to register against the outer peripheral edge of the starter sheet to center the starter sheet within the frame 10. One example of a particularly suitable configuration for the channel 30 is shown in FIG. 3, which illustrates a lateral cross section view of the first side member 14. Here, the channel 30 is formed with a floor 38 positioned at the bottom of the channel 30 and two sides 40, 40' oriented at an angle to the floor 38 of the channel 30. The floor 38 of the channel 30 engages the outer peripheral edge 42 of the starter sheet 44 (shown in phantom) to cause the starter sheet to be centered within the cathode frame 10, and the sides 48, 48' of the channel 30 are oriented at an angle to the floor 38 of the channel 30 so that the sides 48, 48' do not entirely engage the sides 46, 46' of the starter sheet 44. This configuration of the channel 30 not only facilitates metal deposition to the edges 46, 46' of the starter sheet 44, but hold the diaphragm a suitable distance from the starter sheet 44 so that the diaphragm does not interfere with the deposition of metal on the starter sheet 44. That portion of the continuous channel 30 which is formed along the base member 12 of the cathode frame 10, as shown in FIG. 4, is typically configured in the same manner as the channel 30 located in the side members 14, 16. For example, as shown in FIG. 5, the channel 30 formed in the base member 12 may be suitably shaped as shown in FIG. 3 with respect to the side member 14.

The cathode frame 10 shown in FIGS. 1 and 2 is also structured to provide an advantage over other types of cathode frames in providing a radiused corner 50 at the point of transition between the first side member 14 and the base member 12 and another radiused corner 52 positioned at the transition point between the base member 12 and the second side member 16. The radiused corners 50, 52 of the cathode frame 10 provide increased strength in the transition area between the side members 14, 16 and the base member 12 which, in conventional cathode frames made of separate pieces adhesively joined, is subject to degradation due to the harsh environment of the electrolyte coupled with the frequent abuse subjected upon the cathode frame. More importantly, the radiused corners 50, 52 provide additional electrical shielding which facilitates an even deposition of metal on the starter sheet near the corners thereof. Such even deposition makes the cathode plate (i.e., the plated starter sheet) somewhat easier to remove and helps avoid adherence of the diaphragm to the metal deposits so that the diaphragm is not torn when removing the cathode plate from the cathode frame 10.

The known cathode frame 10 illustrated in FIGS. 1 and 2 is suitable for use in electrowinning or electrorefining processes where a diaphragm, or filter media, is not used to enclose the cathode frame 10, such as in the electrowinning of nickel and cobalt. However, in other electrowinning or electrorefining processes, the cathode frame 10 is enclosed in some manner within a diaphragm to keep impurities from penetrating through the media of the diaphragm. Thus, FIG. 6 illustrates the cathode frame 10 of the present invention which is structured to facilitate the attachment of a diaphragm to the cathode frame 10 and which is particularly structured to facilitate removal of the starter sheet from the frame without damaging the cathode frame 10.

Figures 6, 7, 8:
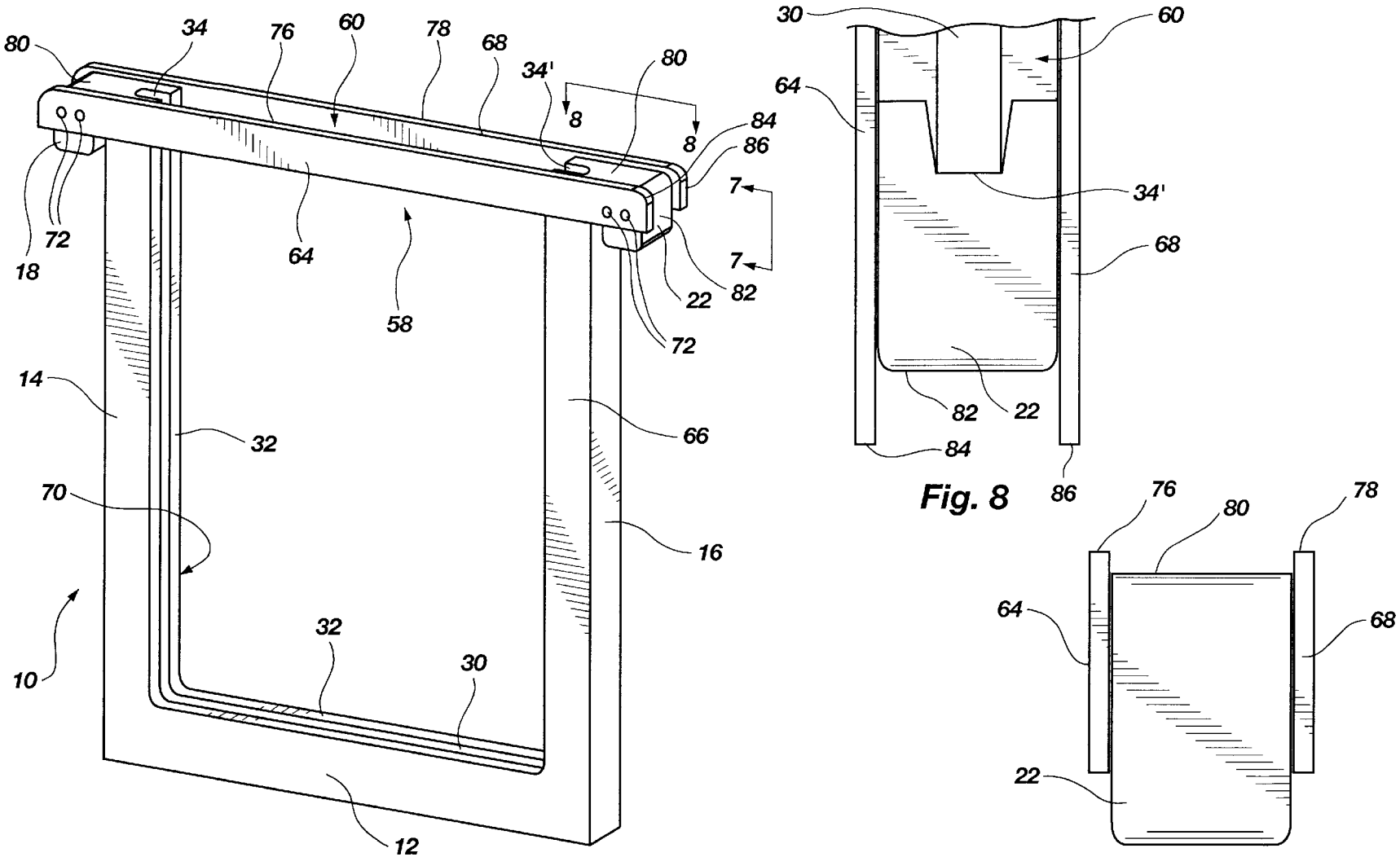
FIG. 6 is a view in perspective of a first embodiment of the cathode frame of the present invention showing a cross frame positioned between the opposing handles.
FIG. 7 is a view in elevation of the handle shown in FIG. 6, taken at line 7—7 thereof.
FIG. 8 is a plan view of one handle of the cathode frame shown in FIG. 6, taken at line 8—8 thereof.
Figure 14:
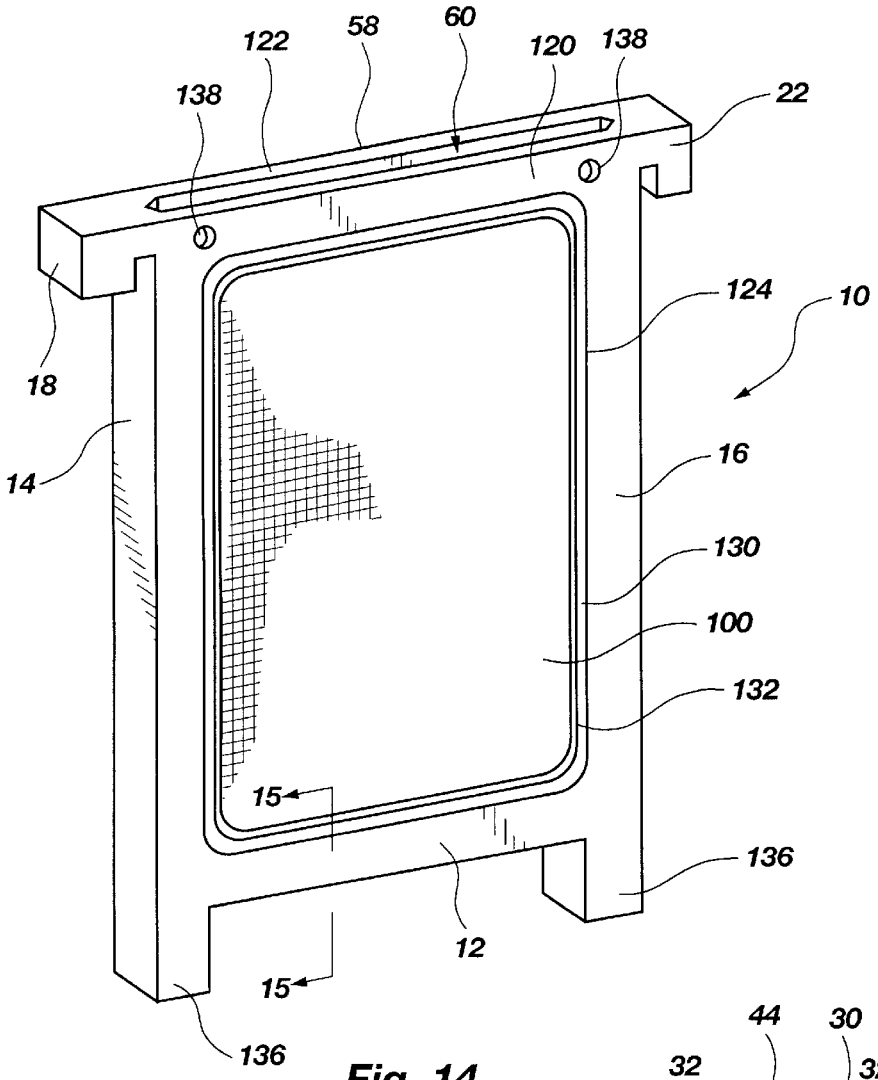
FIG. 14 is a view in perspective of an alternative embodiment of the cathode frame of the present invention where the cross frame is integrally formed with the frame and the diaphragm is attached to the face of the frame.

The cathode frame of the present invention, shown in FIG. 6, includes a cross frame 58 extending between the first side member 14 and the second side member 16 in proximity to the first handle 18 and second handle 22. The cross frame 58, in essence, provides a fourth side to the cathode frame 10. A slot 60 is formed in the cross frame 58 through which the starter sheet (not shown) is inserted, the slot 60 being sized in width to correspond to the top openings 34, 34' of the channel 30. The cross frame 58 may comprise a first cross member 64 positioned between the first side member 14 and second side member 16 on one side 66 of the cathode frame 10 and a second cross member 68 positioned between the first side member 14 and second side member 16 on the opposing side 70 of the cathode frame 10. As shown, the cross members 64,68 may be separate lengths of, for example, stainless steel, plastic or another suitable acid-resistant material, which are attached to the cathode frame 10 by such means as bolts, screws, nails, rabbitting, adhesive bonding or any other suitable securement device 72. That the cross members 64, 68 are separately attached does not detract from the advantages gained in the present invention through integral construction because the cross frame 58 is positioned substantially above the fluid line of the electrolyte in the tank and suffers little or no exposure to the harsh environment of the electrolyte. Alternatively, as shown in FIG. 14 and described more fully hereinafter, the cross frame 58 may be integrally formed as part of the entire body of the cathode frame 10.

The embodiment of the cross frame 58 illustrated in FIG. 6 is particularly advantageous in protecting the cathode frame 10 from harm when the cathode frame 10 is struck in an effort to remove the starter plate (not shown) because the cross members 64, 68 are positioned and secured to the cathode frame 10 so that the top edge 76 of first cross member 64 and the top edge 78 of the second cross member 68 are elevated above the upper surface 80 of the cathode frame 10 at the top openings 34, 34' of the channel 30, the upper surface 80 defining a plane. FIG. 7 illustrates in greater detail that the top edges 76, 78 of the cross members 64, 68 are positioned just proud of the upper surface 80 or plane of the cathode frame 10. Thus, when it is desired to remove the starter plate from the cathode frame 10, striking the cathode frame 10 near the top will result in striking of the cross frame 58 rather than the body of the cathode frame 10, thereby protecting the body from damage.

The cross members 64, 68 may also be sized in length to extend a distance beyond the outermost end surfaces 82 of the both handles 22 (only handle 22 and end surface 82 being visible in FIG. 6) to thereby provide an addition lateral edge 84, 86 of each cross member 64, 68 which may be struck without causing damage to the handles 18, 22 of the frame body. FIG. 8 shows in greater detail how the lateral edges 84, 86 of the cross members 64, 68 extend beyond the end surface 82 of the handle 22. It is understood that the opposing ends of the cross members 64, 68 located in proximity to handle 18 may extend outwardly in a similar manner as described for handle 22 as shown.

In an alternative embodiment of the invention shown in FIGS. 9–11, the cross frame 58 may be structured with two cross members 64, 68 positioned between and connected to the handles 18, 22 of the cathode frame 10, as previously described; however, each cross member 64, 68 may be configured with an upper ledge 90, 92, respectively, which extends inwardly from the outer face 94, 96, respectively, of each cross member 64, 68. As shown more clearly in FIGS. 10 and 11, the upper ledges 90, 92 of each cross member 64, 68 extend inwardly toward each other, but are spaced apart a distance sufficient to provide a slot 60 wide enough to insert and remove the starter plate (not shown) therethrough for positioning in the continuous channel 30 of the cathode frame 10. The cross members 64, 68 may also be sized in length to provide lateral edges 84, 86 which extend beyond the end surface 82 of the handles 22, as previously described, and as shown in FIG. 10. The upper ledges 90, 92 and lateral edges 84, 86 of the cross frame 58 of this embodiment provide a contact surface against which a hammer or other instrument may be struck to enable removal of the starter plate while protecting the cathode frame 10 body from damage.

Figure 12:
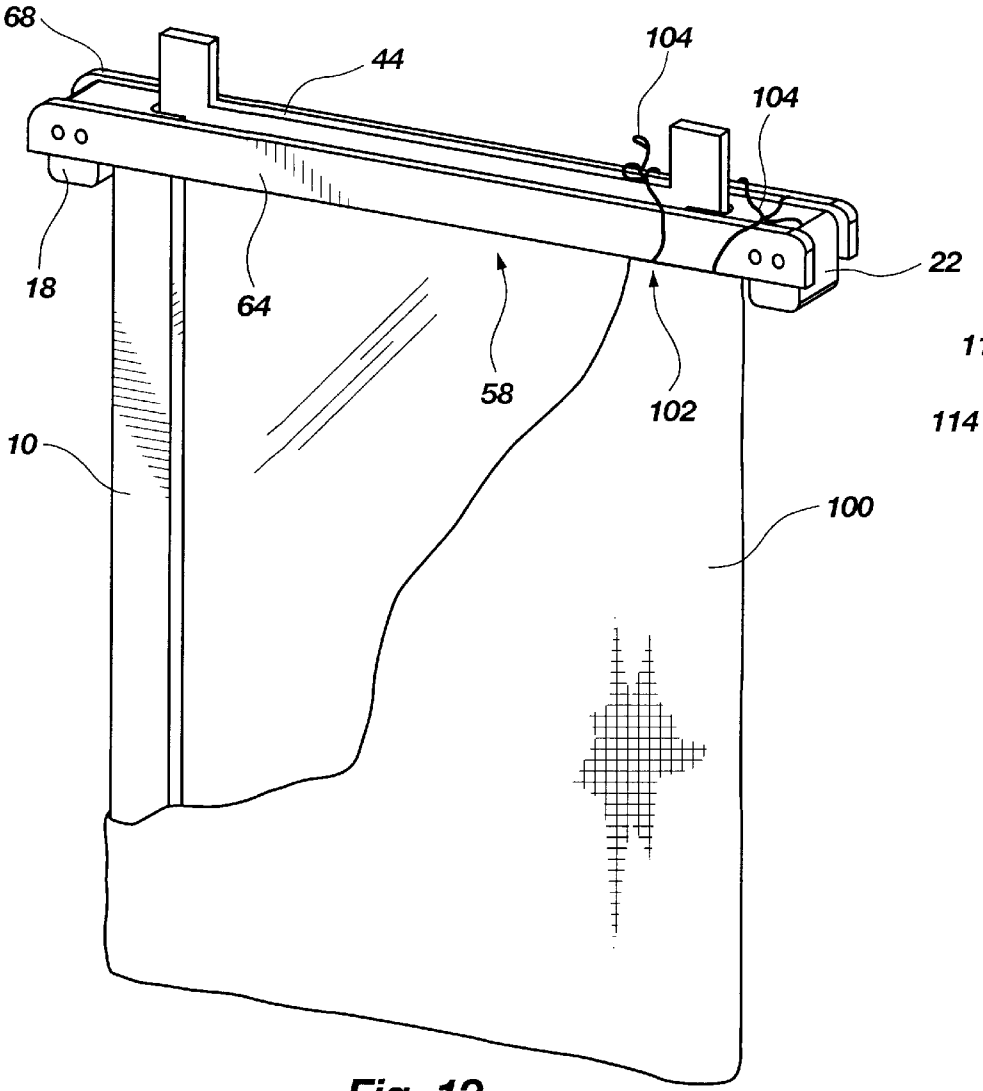
FIG. 12 is a view in perspective of the cathode frame shown in FIG. 6, having a cathode plate inserted in the frame and being covered with a diaphragm, which is shown in partial cutaway.

FIG. 12 further illustrates the first illustrated embodiment of the cathode frame 10 enclosed in a diaphragm 100, which is usually in the form of a woven or cloth bag. The diaphragm 100 is used to keep impurities from passing therethrough while permitting metal ions to pass through to the cathode starter sheet 44. The diaphragm 100 is usually sized to enclose the side members and base member of the cathode frame 10, but does not typically cover the cross frame 58 or handles 18, 22. The top 102 of the diaphragm 100 often dictates the level of electrolyte in the tank so that a proper head can be maintained to enhance the electrolytic process. The diaphragm 100 may, most typically, be attached to the cathode frame 10 by tying or lacing the diaphragm 100 to the cross frame 58 of the cathode frame 10 using compatible material, such as polypropylene tie strings 104, as shown in FIG. 12.

Figure 13:
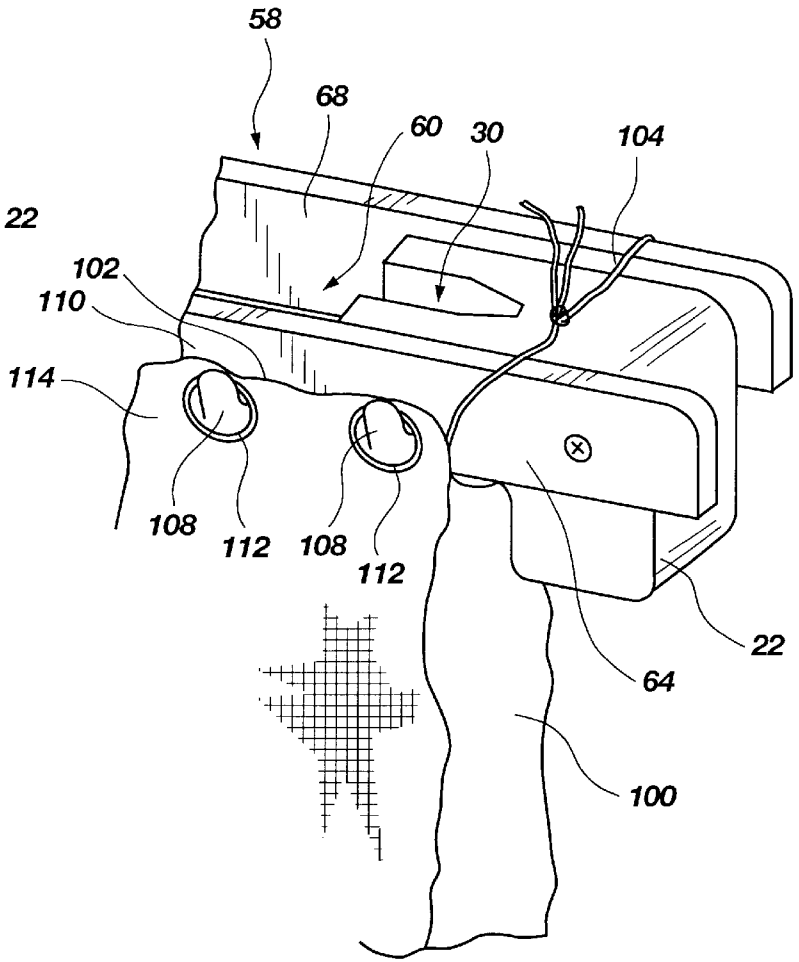
FIG. 13 is an enlarged view of one end of an alternative construction of the cathode frame of the present invention showing hook members formed for attachment of the diaphragm thereto.

Additionally, as shown in FIG. 13, the cross frame 58 may be formed or fitted with attachment devices for attaching the diaphragm 100 to the cathode frame 10 by means other than lacing. For example, hook members 108 may be formed on the outer-facing surface 110 of the cross members 64, 68 to engage grommets 112 formed in the upper edge 14 of the diaphragm 100 as a means of retaining the diaphragm 100 on the cathode frame 10 while leaving the slot 60 unencumbered by threading ties so that the starter plate can be readily removed from the cathode frame 10 without having to first remove the diaphragm 100. Other equally suitable devices may be employed to provide attachment of the diaphragm 100 to the cathode frame 10.

Figure 15:
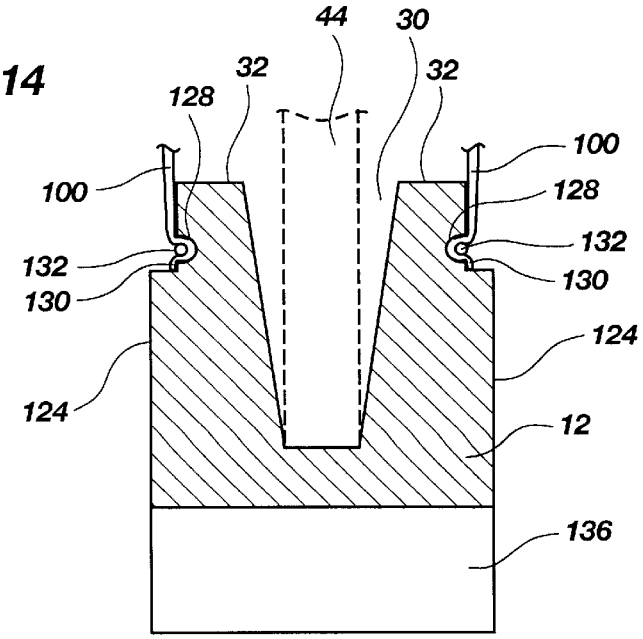
FIG. 15 is an enlarged view in cross section of the base member of the embodiment shown in FIG. 14 taken at line 15—15.

FIG. 14 illustrates an alternative embodiment of the cathode frame 10 of the present invention which is structured with a cross frame 58 formed as is an integral part of the entire body of the cathode frame 10. The embodiment of the cathode frame 10 shown in FIG. 14 is also structured with an alternative means for attaching a diaphragm 100 to the cathode frame 10. The embodiment includes a base member 12 integrally formed to a first side member 14 and a second side member 16, as previously described, but the cross frame 58, comprised of cross members 120 and 122, is integrally formed as a unitary body with the side members 14, 16 and is positioned between the opposing handles 18, 22 as previously described. A slot 60 is defined between the cross members 120, 122 and is sized to receive a starter sheet 44 (FIG. 15) therethrough. As previously described, the starter sheet 44 is held within a continuous channel 30 formed in the cathode frame 10 and is centered therein, as shown in FIG. 15.

The embodiment shown in FIG. 14 is constructed with a continuous and outward facing surface 124 formed along the base member 12, side members 14, 16 and cross members 120, 122 to which a sheet of filter media, or diaphragm 100, is attachable by some means. Notably, while only one side of the cathode frame 10 is shown in FIG. 14, it is understood that the unseen opposing side is similarly structured to accommodate a sheet of filter media, or diaphragm 100, as herein described. The outward facing surface 124 may be structured in some manner to engage the diaphragm 100 for attachment thereto, as illustrated in FIGS. 14 and 15. The outward facing surface 124 may, for example, be formed with a continuous groove 128 encircling the inside edge 32 of the base member 12, side members 14, 16 and cross members 120, 122. The continuous groove 128 is sized to receive the peripheral edge 130 of the diaphragm 100 and a spline 132, such as of rubber material, to retain the diaphragm 100 in a tightly stretched manner across the cathode frame 10. Alternatively, the peripheral edge 130 of the diaphragm 100 may be caulked to the outward facing surface 124. Any number of other suitable means may be employed to attach the diaphragm 100 to the cathode frame 10.

As shown, the cathode frame 10 of this embodiment may also be formed with legs 136 to maintain the cathode frame 10 above the floor of the electrolytic tank, although such legs 136 are optional. Also, the cathode frame 10 shown in FIG. 14 may be suitably formed with apertures 138 in or near the cross members 120, 122 as a means of allowing electrolyte solution circulating within the cathode frame 10 (i.e., between the diaphragm 100 and the starter sheet 44) to escape, thereby maintaining sufficient head to facilitate the electrolytic process.

The cathode frame of the present invention is manufactured as an integral body of material to impart strength and durability to the cathode frame so that it can sustain the normal abuses that cathode frames are subjected to. The material used to form the cathode frame may be any suitable insulating material which can withstand the high temperature and pressure environment of the electrolyte. Such materials are most suitably plastics, a particularly suitable example being polypropylene. The cathode frame is formed by pouring, injecting or extruding flowable material into a mold constructed to provide the design and configuration previously described. The flowable material is then cured in accordance with the manufacturer's recommended specifications and then the mold is opened to retrieve the cathode frame therefrom. The cathode frame may then be machined by known techniques as necessary to provide the finished product. Typical machining that may be employed to finish the cathode frame includes drilling one or more holes in the handles 18, 22 (FIGS. 1, 2 and 6) for attachment of the cross members 64, 68 thereto and machining the radius corners 50, 52 of the cathode frame 10.

In a particularly suitable formation of the cathode frame of the present invention, the plastic material (e.g., polypropylene) used to form the cathode frame may be a glass-reinforced polypropylene. Glass-reinforced polypropylene is available from most plastics compounders. The glass may be added to the plastic material of the cathode frame in a percentage of about 10% to about 40% and is mixed thoroughly before introduction into the mold so that a homogeneous mixture is achieved. The glass-filled plastic composition imparts relatively greater strength to the cathode frame in comparison to conventional materials used, and reduces or eliminates warping, bending or other deformation of the cathode frame caused by the harsh environment of the electrolyte.

The cathode frame of the present invention is particularly formed as an integral body construction to impart strength and durability to the cathode frame and may be adapted for use in many different types of electrolytic processes. Hence, reference herein to specific details of the structure and function of the cathode frame is by reference only and not by way of limitation. Those skilled in the art will recognize that changes may be made to the invention to adapt it to other uses.

What is claimed is:

1. A cathode frame for retaining a cathode plate, comprising:

an integrally-formed frame body having a base member, a first side member oriented perpendicular to said base member, a second side member in parallel orientation to and spaced apart from said first side member, a first handle extending from said first side member and a second handle extending from said second side member;

a continuous channel formed in said integrally-formed frame body extending along said first side member, said base member and said second side member to receive the peripheral edge of a cathode plate therein; and a cross frame extending between said first side member and said second side member, said cross frame being in parallel orientation to said base member and being sized to extend proud of said frame body to provide a contact surface for striking.

2. The cathode frame of claim 1 wherein said frame body further comprises a top surface and said cross frame is sized and oriented to extend proud of said top surface.

3. The cathode frame of claim 2 wherein said first handle and said second handle are each structured with an end surface and wherein said cross frame is structured in size and is positioned to extend proud of each said end surface.

4. The cathode frame of claim 1 wherein said first handle and said second handle are each structured with an end surface and wherein said cross frame is structured in size and is positioned to extend proud of each said end surface.

5. The cathode frame of claim 4 wherein said attachment device is at least one hook.

6. The cathode frame of claim 1 wherein said cross frame is configured with an attachment device for attaching a diaphragm thereto.

7. The cathode frame of claim 1 wherein said cross frame further comprises cross members sized in length to extend between said first side member and said second side member, said cross members being in parallel orientation to each other and in parallel orientation to said base member.

8. The cathode frame of claim 7 wherein each said cross member is sized and positioned to extend proud of an end surface of said first handle and an end surface of said second handle to provide lateral edges for contacting.

9. The cathode frame of claim 8 wherein each said cross member is sized and positioned to extend proud of a top surface of said frame body to provide a contact surface.

10. The cathode frame of claim 7 wherein each said cross member is structured with an outer face and an upper ledge oriented at an angle to said outer face, said upper ledge of each said cross member being positioned to extend inwardly toward the other and to provide a contact surface.

11. The cathode frame of claim 1 further comprising a radiused corner formed between first side member and said base member, and further comprising a radiused corner formed between said base member and said second side member.

12. The cathode frame of claim 1 wherein said unitary frame body is formed of a glass-reinforced polypropylene material.

13. A cathode frame for retaining a cathode plate, comprising:

an integrally-formed frame body having a base member, a first side member oriented perpendicular to said base member, a second side member in parallel orientation to and spaced apart from said first side member, a cross frame extending between said first side member and said second side member, a first handle extending from said first side member and a second handle extending from said second side member;

a continuous channel formed in said integrally-formed frame body extending along said first side member, said base member and said second side member to receive the peripheral edge of a cathode plate therein; and a slot formed in said cross frame in alignment with said continuous channel to receive a cathode plate therethrough.

14. The cathode frame of claim 13 further comprising an outward facing surface structured to retain a diaphragm thereagainst.

15. The cathode frame of claim 14 wherein said outward facing surface is formed with a continuous groove for receiving a peripheral edge of said diaphragm and a retaining spline therein.

16. The cathode frame of claim 14 wherein said cross frame is structured with apertures for releasing electrolytic solution from within said cathode frame.

17. A cathode frame for retaining a cathode plate in an electrowinning processes, said cathode frame comprising a base member integrally-formed with a first side member oriented perpendicular thereto and a second side member oriented perpendicular thereto and a cross frame extending between said first side member and said second side member, said cross frame being in parallel orientation to said base member and having a slot formed therein for receiving a cathode plate therethrough, said base member, first side member and second side member being molded from a glass-reinforced polypropylene material and having a continuous channel formed through said first side member, base member and second side member to receive a cathode plate therein.

18. The cathode frame of claim 17 further comprising a first handle integrally formed to said first side member and a second handle integrally formed to said second side member, said first handle and said second handle being positioned to provide support of said cathode frame in a tank of electrolyte.

19. The cathode frame of claim 17 further comprising a radiused corner transitioning between said first side member and said base member and further comprising a radiused corner transitioning between said base member and said second side member.

* * * * *

UNITED STATES PATENT AND TRADEMARK OFFICE

CERTIFICATE OF CORRECTION

PATENT NO. : 6,231,730 B1
DATED : May 15, 2001
INVENTOR(S) : Steven S. Davis, Forrest B. Day, and Calvin C. Mills It is certified that error appears in the above-identified patent and that said Letters Patent is hereby corrected as shown below:

Title page,
Assignee, delete "EpviroTech" and insert -- EnviroTech --.

Signed and Sealed this

Second Day of April, 2002

*Attest:*

*Attesting Officer*

JAMES E. ROGAN
*Director of the United States Patent and Trademark Office*